US006286322B1

(12) United States Patent
Vogel et al.

(10) Patent No.: US 6,286,322 B1
(45) Date of Patent: Sep. 11, 2001

(54) HOT GAS DEFROST REFRIGERATION SYSTEM

(75) Inventors: Kenneth E. Vogel, Yuma, AZ (US); Robert G. O'Neal, Temecula, CA (US)

(73) Assignee: Ardco, Inc., Brea, CA (US)

( * ) Notice: Subject to any disclaimer, the term of this patent is extended or adjusted under 35 U.S.C. 154(b) by 0 days.

(21) Appl. No.: 09/127,108

(22) Filed: Jul. 31, 1998

(51) Int. Cl.[7] ..... F25D 21/06; F25B 47/02
(52) U.S. Cl. ..... 62/81; 62/278; 62/324.5
(58) Field of Search ..... 62/151, 81, 277, 62/278, 324.5, 506, 507, 509, 197

(56) References Cited

U.S. PATENT DOCUMENTS

| | | | | |
|---|---|---|---|---|
| 2,526,032 | | 10/1950 | La Porte . | |
| 2,706,386 | | 4/1955 | Stoner . | |
| 3,238,737 | | 3/1966 | Shrader et al. . | |
| 3,461,681 | * | 8/1969 | Smith et al. | 62/81 |
| 3,753,356 | | 8/1973 | Kramer | 62/56 |
| 3,777,505 | * | 12/1973 | Otaki | 62/81 |
| 4,102,151 | | 7/1978 | Kramer et al. | 62/278 |
| 4,122,686 | | 10/1978 | Lindahl et al. | 62/81 |
| 4,420,943 | | 12/1983 | Clawson | 62/81 |
| 4,457,138 | | 7/1984 | Bowman | 62/196.1 |
| 4,972,683 | | 11/1990 | Beatenbough | 62/507 |
| 5,050,400 | | 9/1991 | Lammert | 62/278 |
| 5,056,327 | | 10/1991 | Lammert | 62/151 |
| 5,070,705 | | 12/1991 | Goodson et al. | 62/197 |
| 5,379,833 | | 1/1995 | Mathews | 165/113 |
| 5,460,009 | * | 10/1995 | Wills | 62/278 X |
| 5,575,158 | | 11/1996 | Vogel | 62/196.4 |

OTHER PUBLICATIONS

A Guide for Residential Heat Pumps, Selection and Installation (copyright Carrier Corporation 1990 (Rev. 12/92)).
Inside the Heat Pump (copyright Carrier Corporation 1990 (Rev. 2/91)).

* cited by examiner

*Primary Examiner*—Harry B. Tanner

(57) ABSTRACT

A hot gas defrost system for a refrigeration cycle, including at least a compressor, reversing valve, condenser and evaporator. During defrost, the reversing valve directs the superheated refrigerant from the compressor to the evaporator. The hot gas traverses the evaporator coil which, in turn, causes the ice or frost to melt. The hot gas defrost refrigeration system may also include a receiver to store the refrigerant during the refrigeration and defrost cycles.

17 Claims, 11 Drawing Sheets

HOT GAS DEFROST REFRIGERATION SYSTEM

FIELD OF THE INVENTION

The present invention relates in general to a refrigeration system and, in particular, to a refrigeration system with a hot gas defrost circuit having a reversing valve for periodic defrosting.

BACKGROUND OF THE INVENTION

Various techniques for defrosting refrigeration systems are known. For example, a common method for defrosting a refrigeration system is to stop the refrigeration cycle and activate heaters placed near the evaporator coils. These heaters defrost and deice the evaporator coil. This method, however, is time consuming and often causes undesirable heating of the refrigerated area. Another method for defrosting refrigeration systems is to reverse the refrigeration cycle. When the refrigeration cycle is reversed, hot refrigerant vapor from the compressor is directed into the evaporator outlet, through the evaporator, into the condenser inlet, through the condenser, and back into the compressor. A problem with this method is that often the temperature of refrigerant entering the compressor is so low that some liquid is introduced into the compressor. This liquid may damage or destroy the compressor. In addition, the temperature of the refrigerant entering the evaporator is often too low for rapid or complete defrosting of the evaporator. Thus, the defrost cycle may be very time consuming or the evaporator may not be completely defrosted.

A conventional refrigeration defrost system is shown in U.S. Pat. No. 4,102,151 issued to Kramer, et al. The Kramer patent discloses a hot gas defrost system in which superheated refrigerant vapor from the compressor is routed through a tank filled with water. The superheated refrigerant vapor heats the water in the tank to a high temperature. The hot refrigerant then traverses the evaporator to defrost the evaporator coil. The refrigerant exiting the evaporator is then routed through the tank containing the hot water to reheat the refrigerant and ensure that all the refrigerant is in vapor form. The vapor refrigerant then enters the compressor to complete the defrost cycle. This defrost system requires a complex system of pipes, valves and a large water tank.

A conventional refrigeration defrost system is also shown in U.S. Pat. No. 5,056,327 issued to Lammert. The Lammert patent discloses a hot gas defrost system in which, during the defrost cycle, a series of valves and pipes are used to direct the refrigerant through the compressor, evaporator, condenser and back to the compressor, thereby utilizing the condenser as a reevaporator during the defrost cycle. The Lammert patent also discloses a superheater in a defrost passage which receives refrigerant from the condenser outlet during the defrost cycle and delivers it to the compressor inlet. Additionally, the Lammert patent discloses a passage, which connects the compressor outlet and the evaporator inlet, that is, in a heat exchange relationship with the superheater in the defrost passage. The superheater allows heat from the hot vapor refrigerant discharged from the compressor to be used to heat the refrigerant delivered to the compressor inlet. This refrigeration defrost system undesirably requires numerous valves, pipes and a superheater to appropriately route the refrigerant during the defrost cycle.

Another conventional refrigeration system is disclosed in U.S. Pat. No. 5,050,400 also issued to Lammert. This Lammert patent discloses a refrigeration system including a series of valves and interconnecting fluid passages which allow refrigerant to flow sequentially from the compressor to the evaporator and, via a defrost passage, to the condenser and back to the compressor during the defrost cycle. This system includes a combined superheater/receiver located in the defrost passage for use during the defrost cycle. The combined superheater/receiver includes an inlet for receiving refrigerant from the condenser during the refrigeration cycle, a first outlet for delivering liquid refrigerant to the evaporator during the refrigeration cycle, and a second outlet for delivering refrigerant vapor to the compressor during the defrost cycle. During the defrost cycle, the system also employs a closed fluid conduit which uses the hot vapor refrigerant discharged from the compressor to heat the refrigerant entering the compressor. This closed fluid conduit ensures that all the refrigerant entering the compressor is in vapor form. Undesirably, this refrigeration defrost system requires extensive hardware, including numerous pipes and valves, to accomplish the appropriate routing of the refrigerant during the defrost cycle. This refrigeration system also requires the use of a superheater/receiver which adds to the complexity and cost of the system.

SUMMARY

The present invention is an improved refrigeration system with a simplified hot gas defrost circuit that eliminates the complexities of conventional defrost systems. In one aspect of the invention, the refrigeration system includes a compressor, a condenser, an evaporator, an expansion valve, a defrost valve, and a reversing valve. During the refrigeration cycle, the reversing valve directs the flow of refrigerant from the compressor to the condenser, and the reversing valve directs the flow of refrigerant from the evaporator to the compressor. During the defrost cycle, the reversing valve directs the flow of refrigerant from the compressor to the evaporator and then to the condenser, and the reversing valve directs the flow of refrigerant from the condenser to the compressor. Advantageously, the present invention provides an energy efficient and cost efficient hot gas defrost refrigeration system, particularly in temperate and cold climates. In addition, the present invention eliminates the complex system of pipes and valves required in conventional defrost systems.

In another aspect of the invention, the refrigeration system includes a receiver disposed between the condenser and the evaporator. During the refrigeration cycle, the refrigerant exiting the condenser bypasses the defrost valve and enters the receiver. The refrigerant then flows out of the receiver, through the expansion valve and into the evaporator. During the defrost cycle, refrigerant flows from the condenser into the compressor and refrigerant flows from the evaporator and into the receiver. The refrigerant then flows out of the receiver, through the defrost valve and into the condenser to complete the defrost cycle.

In yet another aspect of the invention, the refrigeration system includes two reversing valves. During refrigeration, a first reversing valve directs refrigerant discharged from the compressor into the condenser and a second reversing valve directs the refrigerant from the condenser into a receiver. The second reversing valve also directs the refrigerant from the receiver into the evaporator. During the defrost cycle, the first reversing valve directs the refrigerant discharged from the compressor into the evaporator and the second reversing valve directs the refrigerant from the evaporator into the receiver. The second reversing valve also directs the refrigerant from the receiver into the condenser. Advantageously, the two reversing valves eliminate the need for a second passage connecting the evaporator and the condenser.

Further advantages and applications of the present invention will become apparent to those skilled in the art from the following detailed description of the preferred embodiments and the drawings referenced herein, the invention not being limited to any particular embodiment.

BRIEF DESCRIPTION OF THE DRAWINGS

These and other features of the invention will now be described with reference to the drawings of preferred embodiments, which are intended to illustrate and not to the limit the invention, in which.

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following detailed description of the preferred embodiments of the present invention is not intended to limit the scope of the invention, as claimed, but it is merely representative of the presently preferred embodiments of the invention.

Figure 1A:
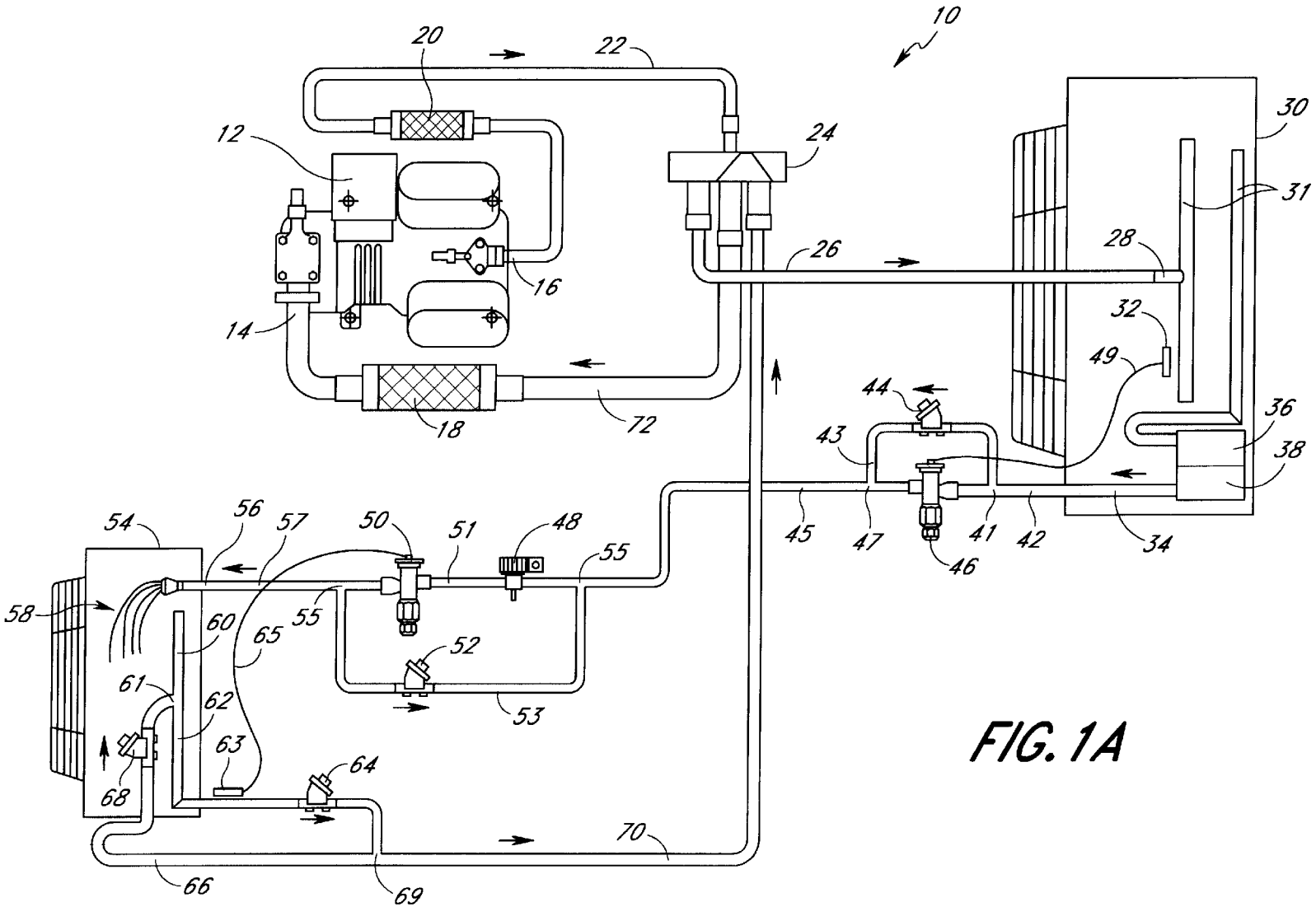
FIG. 1A is a schematic drawing of an embodiment of the present invention of a hot gas defrost refrigeration system, including a receiver and subcooler coils as part of a condenser.
Figure 1B:
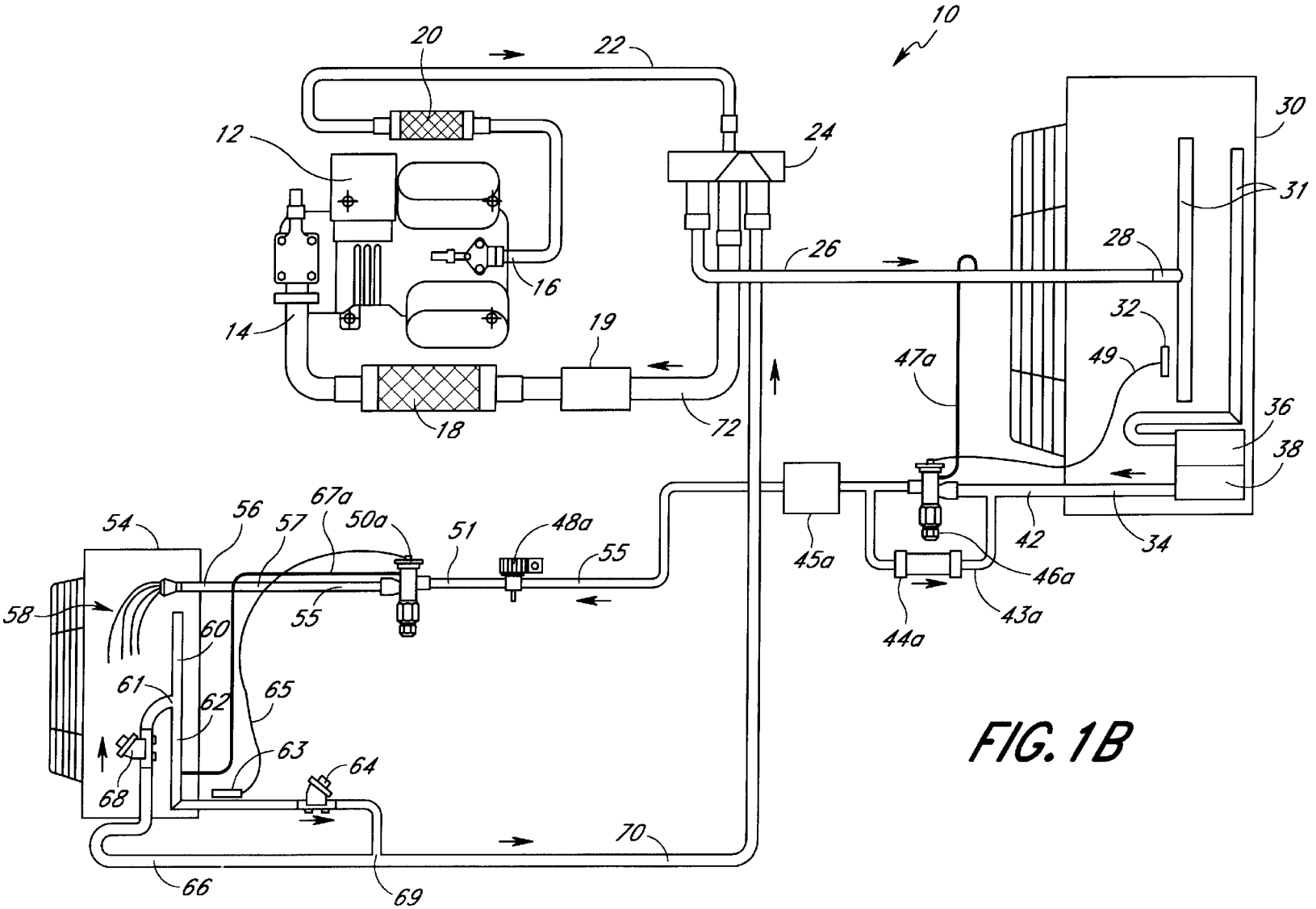
FIG. 1B is a schematic drawing of another embodiment of the present invention of a hot gas defrost refrigeration system, including a receiver and subcooler coils as part of a condenser.

As shown in FIGS. 1A and 1B, a hot gas defrost refrigeration system 10 is configured in accordance with a preferred embodiment of the invention. In this embodiment, the refrigeration system 10 includes a compressor 12, preferably a conventional type compressor with a low pressure inlet port 14 and a high pressure outlet port 16. The compressor 12 may include conventional vibration eliminators 18, 20 proximate the inlet 14 and outlet 16, respectively, as known to those skilled in the art. As shown in FIG. 1B, the refrigeration system 10 may also include a suction filter 19 positioned proximate the inlet 14 of the compressor 12, but the suction filter is not required. The refrigeration system 10 also includes a passage 22 connecting the outlet port 16 of the compressor 12 to a reversing valve 24. The reversing valve 24 is connected by a passage 26 to a first gas port 28 of a condenser 30. The condenser 30 typically includes a series of coils 31 to facilitate heat transfer between the refrigerant and the environment surrounding the condenser 30. A sensor 32 located proximate the first gas port 28 is used to measure the temperature of the refrigerant. The sensor 32 is preferably connected to a portion of the coil 31 proximate the first gas port 28, more preferably, the sensor is attached to the coil at a position in which the refrigerant is no longer superheated, and most preferably the sensor includes a temperature sensitive bulb located on the dog-leg return of the condenser coil. It will be understood that the sensor 32 can be attached to any desired portion of the coil 31 and the sensor may also be connected to the passage 26 proximate the first gas port 28.

The condenser 30 is typically air cooled and located outdoors to expedite heat transfer. The condenser 30 may include one or more fans (not shown in the accompanying figures) to increase heat transfer. The condenser 30 preferably includes a receiver 36 and a subcooler 38 as part of the condenser coil. More preferably, the condenser 30 includes a receiver and subcooler as disclosed in assignee's co-pending U.S. application Ser. No. 08/500,319 filed Jul. 10, 1995, now U.S. Pat. No. 5,660,050 titled "REFRIGERATION CONDENSER, RECEIVER AND SUBCOOLER SYSTEM", which is hereby incorporated by reference in its entirety. This condenser is available from the assignee under the trade Sierra Circuit trade name. In this preferred arrangement, the receiver and subcooler portions of the condenser allow up to about a 25% increase in heat transfer capacity, with a decrease of about 10% in refrigerant charge required for efficient refrigeration. That arrangement significantly increases the efficiency of both the refrigeration and defrost cycles. The circuit also advantageously allows the refrigeration system to operate more efficiently in colder climates. Of course, one skilled in the art will understand the refrigeration system does not require the use of a condenser with a receiver and subcooler as part of the condenser.

The condenser 30 includes a first liquid port 34 which is connected to passage 42. As shown in FIG. 1A, the passage 42 is connected to a defrost valve 46 which is connected in parallel with a check valve 44 located in a bypass passage 43. The defrost valve 46 and bypass passage 43 are also connected to passage 45. The bypass passage 43 is connected to passages 42 and 45 by tee-joints 41 and 47, respectively. The defrost valve 46 is preferably an expansion valve, and more preferably a thermostatic expansion valve. Most preferably the defrost valve 46 is a type EMC valve from the SPORLAN Valve Company of Washington, Mo. The type EMC thermostatic expansion valve is described in more detail below.

In another preferred embodiment, as shown in FIG. 1B, the refrigeration system 10 has generally the same components as that disclosed in connection with FIG. 1A, but the defrost valve and check valve are incorporated into a single valve 46*a* which acts as an expansion valve when the flow is in one direction and as a check valve when the flow is in the other direction. This valve 46*a* is also referred to as a defrost thermal expansion valve with an integral check valve. Additionally, an equalizer line 47*a* connects the valve 46*a* to the passage 26 connecting the reversing valve 24 to the condenser 30. Further, the bypass line 43*a* includes a relief valve 44*a* which, under certain circumstances, allows refrigerant to be vented to the condenser 30 if the pressure reaches a specific point.

As shown in FIGS. 1A and 1B, a line 49 connects the valves 46 and 46*a* to the sensor 32 in the condenser 30 and the line allows the valves to be adjusted according to the temperature of the refrigerant proximate the inlet to the condenser 30. In detail, the sensor 32 preferably comprises a refrigerant filled bulb and the line 49 preferably comprises a capillary line which connects the bulb to the valves 46 and 46*a*. The bulb is preferably positioned so that when the temperature of the refrigerant in the coil proximate the sensor 32 varies, the temperature and pressure of the refrigerant in the bulb also varies. This causes a corresponding change in the pressure of the line 49, and the pressure change in the line allows the valves 46 and 46*a* to be adjusted as desired.

Referring again to FIG. 1A, the passage 45 is connected to a tee-joint 55 which joins parallel passages 51 and 53. The passage 51 includes a solenoid valve 48 and an expansion valve 50 connected in series. The solenoid valve 48 is preferably a liquid solenoid valve and the expansion valve 50 is preferably a thermostatic expansion valve, and most preferably a type EMC valve from the SPORLAN Valve Company of Washington, Mo., which is described in more detail below. The thermal expansion valve 50 operates because of a differential pressure so that the high pressure liquid refrigerant becomes a low pressure liquid refrigerant prior to entry into an evaporator 54. Connected in parallel with the expansion valve 50 and solenoid valve 48 is a check valve 52 in passage 53. Another tee-joint 55 connects passages 51 and 53 to passage 57. The passage 57 is connected to a first liquid port 56 of the evaporator 54. The evaporator 54 preferably includes a conventional coil 58 and one or more fans (not shown) to assist in heat transfer between the evaporator coil 58 and the refrigerated space.

It will be appreciated that the refrigeration system 10 in any of the embodiments disclosed herein may include one or multiple evaporators such as two or four, but it will be appreciated that the system may include any number of evaporators. Advantageously, this allows the system 10 to refrigerate large areas or multiple different areas. Additionally, in contrast to conventional heat pumps which have a temperature range of the refrigerant entering the evaporator of 40–45° F. (referred to as the suction temperature), the temperature of the refrigerant entering the evaporator 54 of the system 10 is preferably about 25° F. or lower, but the refrigerant may also have a higher temperature.

As shown in FIG. 1B, the passage 45 includes a bi-flow liquid filter 45*a* which filters the refrigerant when flowing in either direction in the passage. The passage 45 also includes a bi-flow solenoid valve 48*a* in series with valve 50*a* which acts as an expansion valve when the flow is in one direction and a check valve when the flow is in the other direction. This valve 50*a* is also referred to as a normal thermal expansion valve with an integral check valve. The bi-flow solenoid valve 48*a*, combination expansion and check valves 46*a* and 50*a*, and bi-flow liquid filter 45*a* are available from the SPORLAN Valve Company of Washington, Mo. and the Alco Controls Division of Emerson Electric GmbH & Co. of Waiblingen, Germany.

As shown in FIGS. 1A and 1B, the evaporator 54 includes a first gas port 60 connected by a tee-joint 61 to a passage 62 and drain pan circuit 66. The passage 62 includes a sensor 63 and a check valve 64. The sensor 63 measures the temperature in passage 62 proximate the first gas port 60 and the sensor 63 is connected by a line 65 to the expansion valve 50. In detail, the sensor 63 comprises a refrigerant filled bulb and the line 65 comprises a capillary line. The bulb is preferably located proximate the passage 62 and in a heat exchange relationship with the refrigerant in the passage 62. When the temperature of the refrigerant in the bulb changes, the temperature and pressure of the refrigerant in the bulb and line 65 also changes. This change in pressure in the line 65 is used to adjust the valves 50 or 50*a*. The drain pain circuit 66 includes a check valve 68 which controls the flow of refrigerant through the circuit 66. The passages 62 and 66 are joined at a tee-joint 69 to a passage 70. The passage 70 is connected to the reversing valve 24 and the reversing valve 24 is connected by passage 72 to the low pressure inlet port 14 of the compressor 12.

As seen in FIG. 1B, the system 10 may also include a line 67*a* which connects the valve 50*a* to the passage 62 in the evaporator 54. The line 67*a* is preferably connected proximate the exit of the evaporator 54 so that the pressure of the refrigerant leaving the evaporator can be communicated to the valve 50*a*. This allows the valve 50*a* to control the amount of refrigerant flowing into the evaporator 54, which determines the amount of refrigerant exiting the evaporator. Advantageously, the valve 50*a* can work in conjunction with the sensor 63 and line 65 to determine both the temperature and pressure of the refrigerant leaving the evaporator so that the flow of refrigerant to the evaporator can be adjusted accordingly. This allows the valve 50*a* to be used to ensure that no liquid refrigerant flows to the compressor 12 which may damage or destroy the compressor.

As mentioned above, the refrigeration system 10 may include one or more condenser fans which expedite heat transfer. These condenser fans are located near the condenser 54 and the fans, for example, may have variable speeds and may be automatically controlled according to factors such as temperature and pressure of the refrigerant and/or the surrounding environment, but the fans may also be fixed on/off fans. The fans advantageously may assist in controlling the pressure in the refrigeration cycle 10. For example, during a refrigeration cycle, if the pressure is low or normal, the condenser fans are preferably turned off, but if the pressure is high, then the condenser fans are preferably be turned on.

Another feature of the system disclosed in assignee's co-pending U.S. application Ser. No. 08/500,319 is a floating head system which allows the condenser pressure to vary with ambient temperature. In this system, the expansion valve requires a differential pressure of at least about 25 pounds, thus subcooling of the refrigerant is often required prior to entry into the evaporator. At the initial start-up of the system, or after a defrost cycle, there is a large load on the compressor and a pressure controller toggles the solenoid valve, which is responsive to the compressor suction pressure. Also at start-up, with a low pressure refrigerant in the condenser (the condenser may also include a receiver containing low pressure refrigerant), a check valve supplies pressurized refrigerant to an expansion valve prior to delivery of the refrigerant to the evaporator. A pressure relief valve is used for hydrostatic pressure from the temperature increase in the line. Preferably the floating head system is used in conjunction with the Sierra Circuit to advantageously allow the refrigeration system to operate in colder climates without requiring use of the condenser fans during defrost. The system, of course, does not require the use of the floating head system or Sierra Circuit.

FIG. 1A illustrates a preferred embodiment of the flow of refrigerant during the refrigeration cycle. In operation, the compressor 12 delivers refrigerant at high pressure and high temperature to the passage 22. One skilled in the art will understand that the term passage is defined broadly to include lines, conduits, tubes, hoses and the like for the routing of the refrigerant during the refrigeration and defrost cycles. The reversing valve 24, during the refrigeration cycle, directs the vapor refrigerant through the passage 26 to the condenser 30. After the refrigerant is condensed into a liquid, the liquid flows out of the liquid port 34 and into the passage 42. The liquid flows through the open check valve 44, bypassing the defrost valve 46, and through the solenoid valve 48 and expansion valve 50 to the evaporator 54. Closed check valve 52 prevents the flow of refrigerant through the bypass passage 53. The liquid refrigerant then enters the evaporator 54 where the refrigerant absorbs heat and is transformed into a gas. The gaseous refrigerant flows out of the first gas port 60 and into the passage 62. The refrigerant flows through the check valve 64, into the passage 70 and to the reversing valve 24. Check valve 68 prevents the refrigerant from flowing through the drain pan circuit 66. The reversing valve 24 directs the refrigerant through passage 72 to the compressor 12. This completes the refrigeration circuit shown in FIG. 1A.

FIG. 1B illustrates another preferred embodiment of the flow of refrigerant during the refrigeration cycle. In operation, the compressor 12 delivers refrigerant at high pressure and high temperature to the passage 22. The reversing valve 24, during the refrigeration cycle, directs the vapor refrigerant through the passage 26 to the condenser 30. After the refrigerant is condensed into a liquid, the liquid flows out of the liquid port 34, into the passage 42 and through the valve 46*a* which acts as a check valve. The liquid then flows through the bi-flow liquid filter 45*a*, bi-flow solenoid valve 48*a*, and valve 50*a* which acts as an expansion valve. The refrigerant flows through the evaporator 54 and out of the first gas port 60 into the passage 62. The refrigerant flows through the check valve 64, into the passage 70 and to the reversing valve 24. Check valve 68 prevents the refrigerant from flowing through the drain pan circuit 66. The reversing valve 24 directs the refrigerant through passage 72 to the compressor 12. This completes the refrigeration circuit shown in FIG. 1B.

Figure 2A:
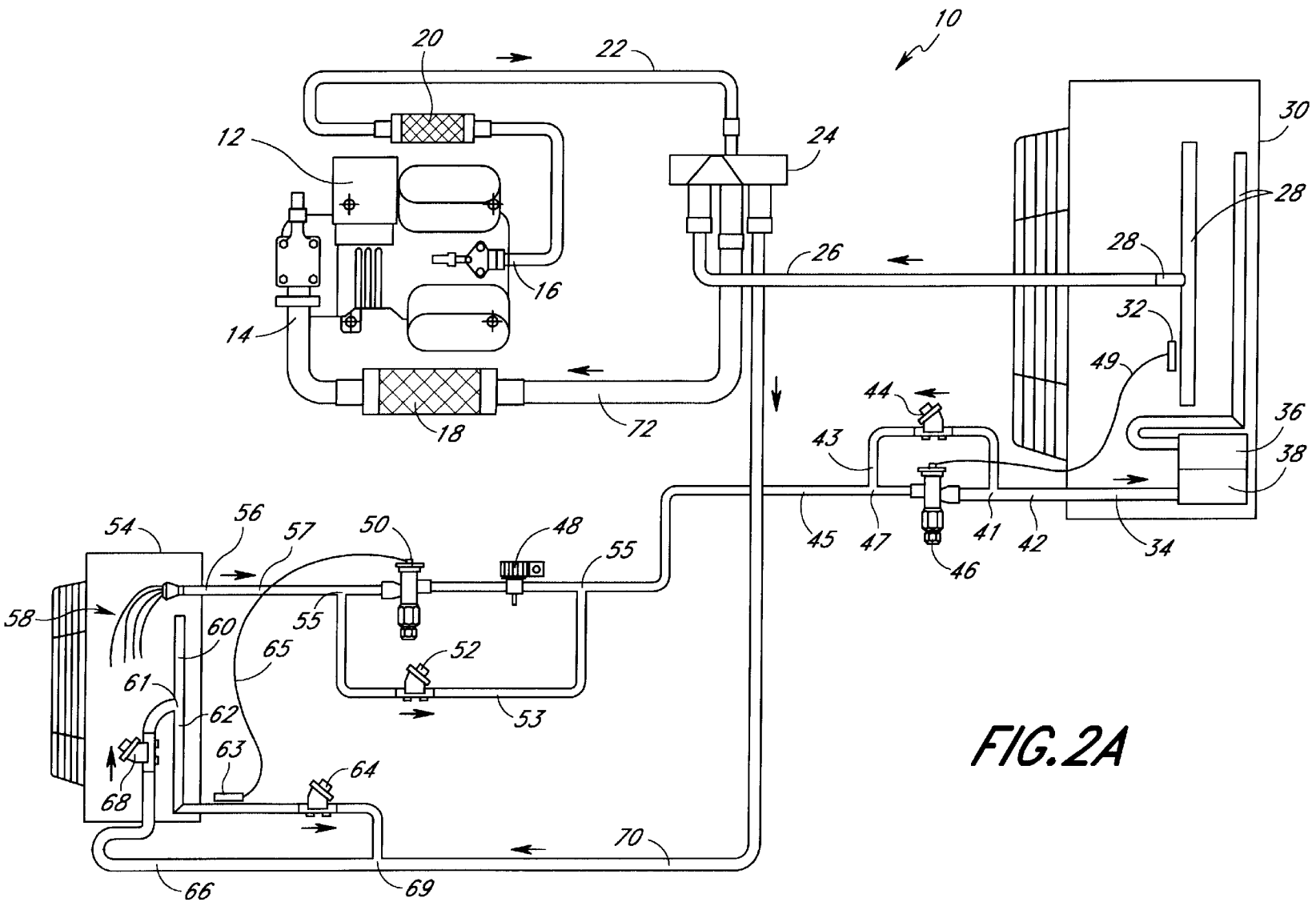
FIG. 2A is a schematic drawing of the embodiment of the system in FIG. 1A, showing a defrost cycle.

FIG. 2A illustrates the flow of refrigerant during a defrost cycle for the embodiment shown in FIG. 1A. During defrost, the hot refrigerant vapor from the compressor 12 flows through the passage 22 to the reversing valve 24. The reversing valve directs the hot refrigerant vapor into the passage 70 connected to the first gas port 60 of the evaporator 54. The check valve 64 is closed to prevent the high pressure refrigerant vapor from traversing the passage 62. The refrigerant flows through the drain pan circuit 66 and check valve 68 into the evaporator 54. The hot gas traverses the evaporator 54 to defrost and deice the components within the evaporator 54, such as the coil 58 and the drain pan. High pressure liquid refrigerant then flows out of the first liquid port 56 of the evaporator and into the passage 57. The check valve 52 in the bypass line 53 is open to allow the refrigerant to bypass the expansion valve 50 and the solenoid valve 48. The solenoid valve 48 is preferably closed so that all of the refrigerant flows through the bypass passage 53.

The refrigerant flowing through passage 45 then traverses the defrost valve 46. The defrost valve 46 is preferably a thermostatic expansion valve that lowers the pressure of refrigerant. The closed check valve 44 prevents the flow of refrigerant through the bypass passage 43. The low pressure refrigerant then flows through the condenser 30 and into the passage 26. The condenser fans may be left on for operation in temperate climates. In colder climates, where the ambient pressure differential is less, the condenser fans are preferably turned off to expedite return of the condenser to refrigeration operation. The reversing valve 24 then directs the refrigerant into the passage 72 connected to the low pressure inlet port 14 of the compressor 12. This completes the defrost circuit shown in FIG. 2A.

Figure 2B:
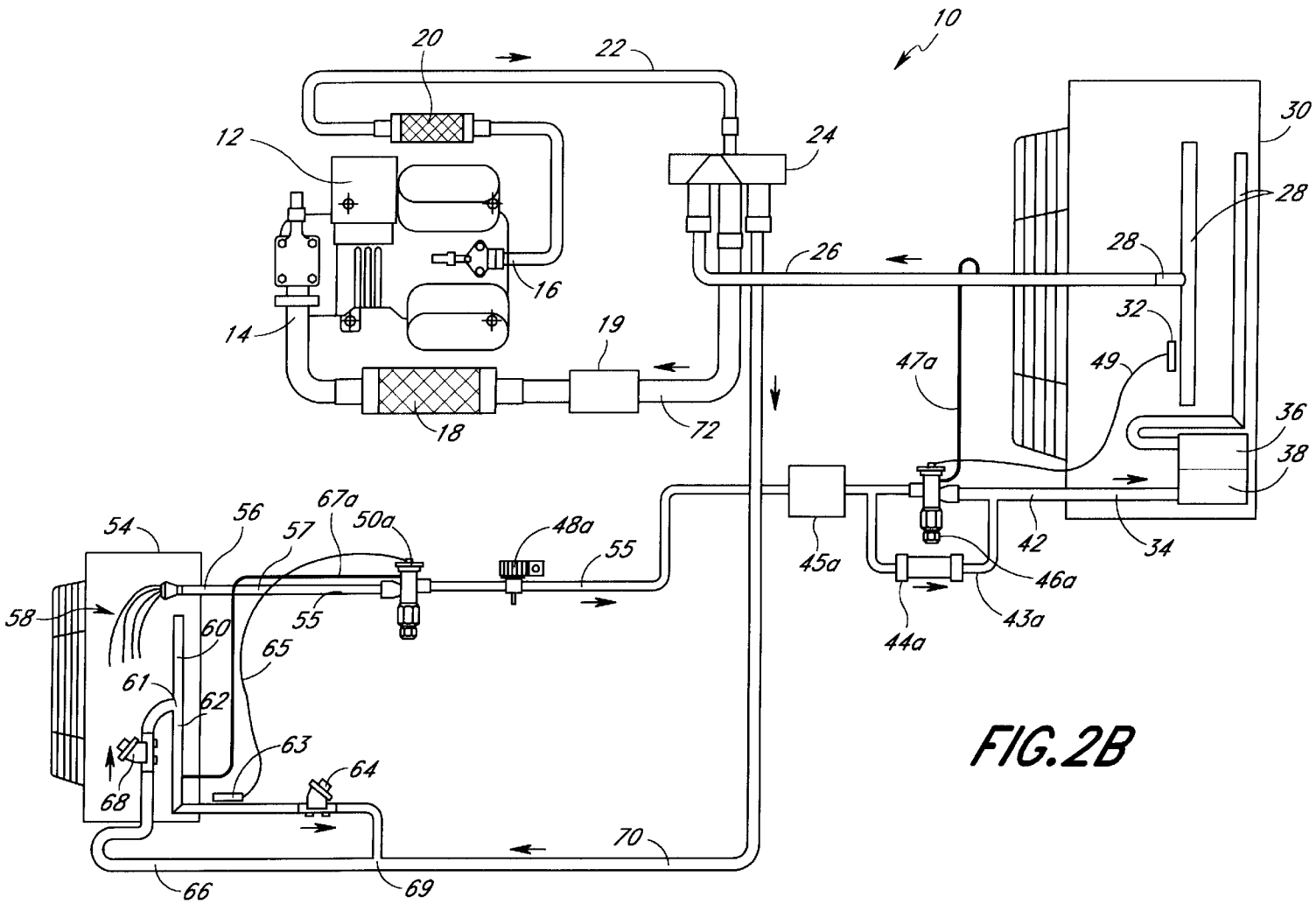
FIG. 2B is a schematic drawing of the embodiment of the system in FIG. 1B, showing a defrost cycle.

FIG. 2B illustrates the flow of refrigerant during a defrost cycle for the embodiment shown in FIG. 1B. During defrost, the hot refrigerant vapor from the compressor 12 flows through the passage 22 to the reversing valve 24. The reversing valve directs the hot refrigerant vapor into the passage 70 connected to the first gas port 60 of the evaporator 54. The check valve 64 is closed to prevent the high pressure refrigerant vapor from traversing the passage 62 and the refrigerant flows through the drain pan circuit 66 and check valve 68 into the evaporator 54. The hot gas traverses the evaporator 54 to defrost and deice the components within the evaporator 54, such as the coil 58 and the drain pan. High pressure liquid refrigerant then flows out of the first liquid port 56 of the evaporator, into the passage 57 and through the valve 50*a* which acts like a check valve and through the bi-flow solenoid valve 48*a*.

The refrigerant flowing through passage 45 then traverses the bi-flow liquid filter 45*a* and the valve 46*a* which, for refrigerant flowing in this direction, is a thermostatic expansion valve that lowers the pressure of refrigerant. The equalizer line 47*a* attached to the valve 46*a* includes a temperature sensitive bulb which measures the temperature of the refrigerant in the passage 26 and the valve 46*a* includes a pressure sensor which measures the pressure of the refrigerant entering the condenser 30. The valve 46*a* controls the amount of refrigerant entering the condenser during the defrost cycle to ensure that only vapor exits the condenser and no liquid is supplied to the compressor. The low pressure refrigerant then flows through the condenser 30 and into the passage 26. The condenser fans may be left on for operation in temperate climates but in colder climates, where the ambient pressure differential is less, the condenser fans are preferably turned off to expedite return of the condenser to refrigeration operation. The reversing valve 24 then directs the refrigerant into the passage 72 connected to the low pressure inlet port 14 of the compressor 12. This completes the defrost circuit shown in FIG. 2A.

The defrost cycles shown in FIGS. 2A and 2B preferably terminate when a predetermined pressure in the system 10 is reached. Under some circumstances, because the pressure in the system 10 could build up hydrostatically, the relief valve 44*a* in the bypass line 43*a* allows refrigerant to bypass the valve 46*a* and flow directly to the condenser 30 if the pressure exceeds a predetermined point. Advantageously, the relief valve 44*a* is adjustable so that the pressure at which the valve 44*a* allows flow can be adjusted according the desired use of the system 10.

Additionally, the evaporator fans are preferably turned off during the defrost cycle to prevent the fans from blowing warm air into the refrigerated spaces. More preferably, the evaporator fans are controlled by an electronic time delay in which the fans are not turned on after the defrost cycle until the evaporator coil is cooled by the refrigeration cycle. Further, the condenser fans are preferably turned on at full speed to ensure maximum cooling of the refrigerant flowing through the condenser 30 during the defrost cycle.

Figure 3:
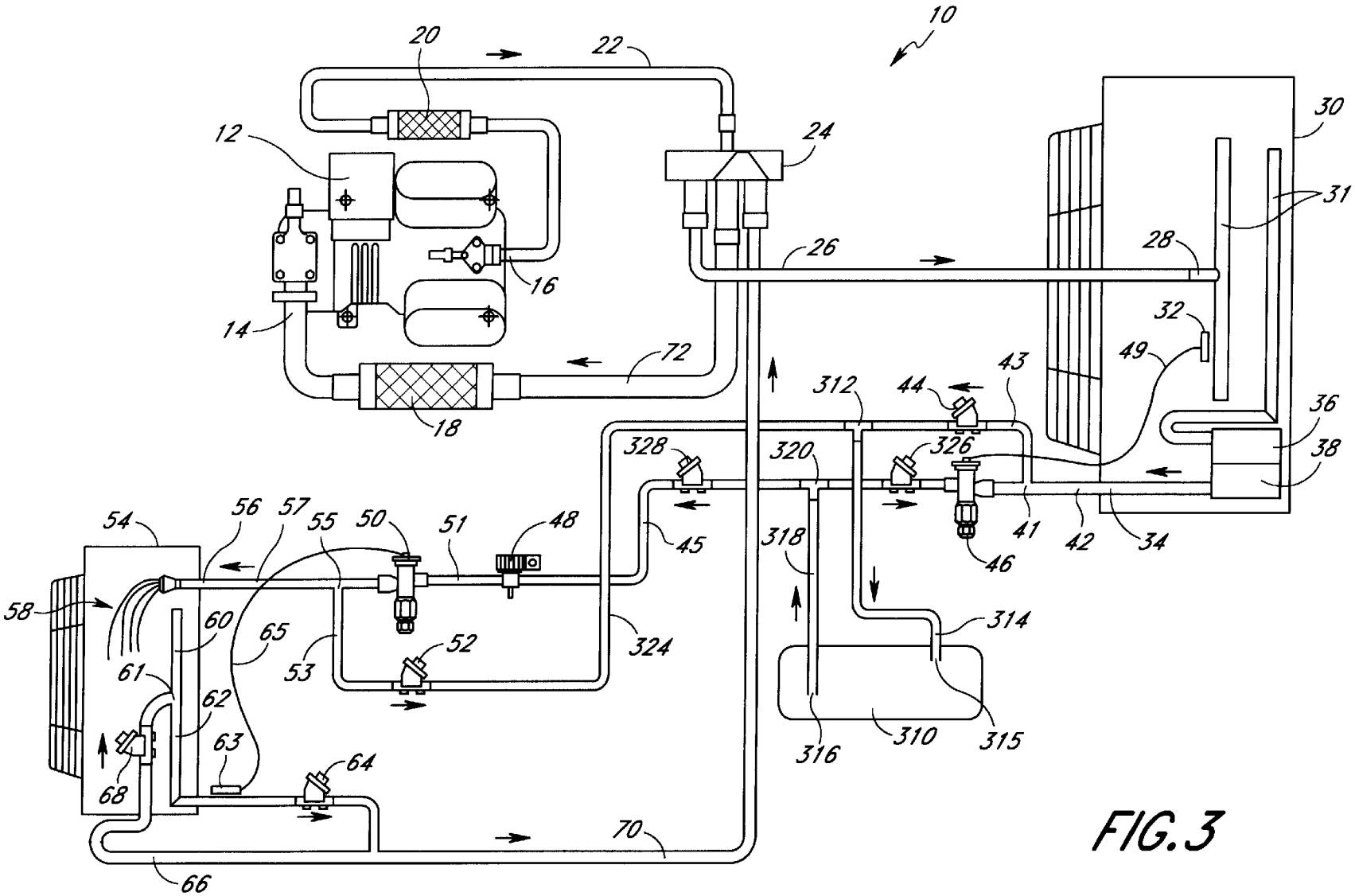
FIG. 3 is a schematic drawing of another embodiment of the present invention, including a receiver between the condenser and the evaporator, showing a refrigeration cycle.
Figure 4:
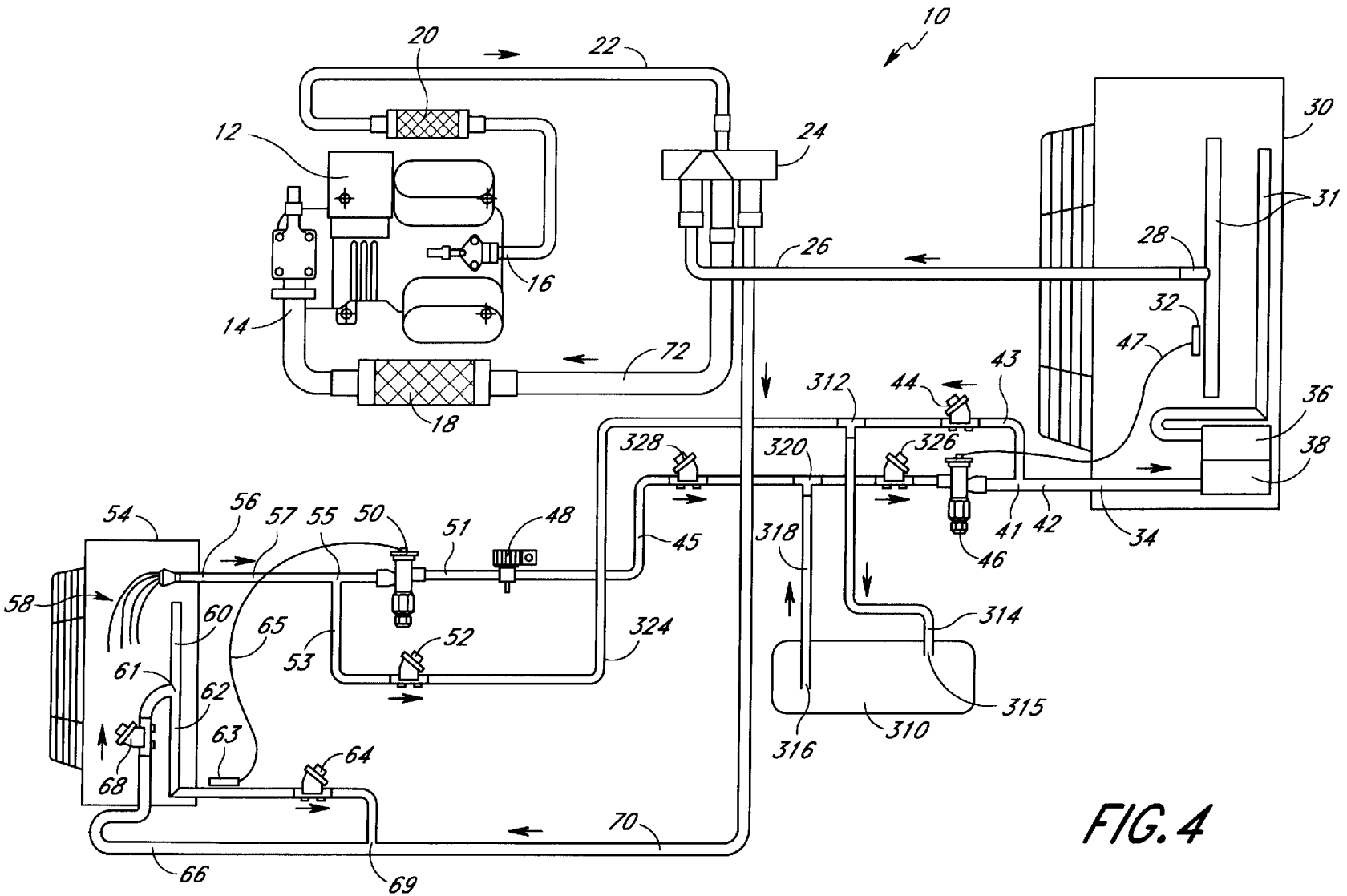
FIG. 4 is a schematic drawing of the embodiment of the system in FIG. 3, showing a defrost cycle.

Another preferred embodiment of the hot gas defrost refrigeration system 10 is shown in FIGS. 3–4. Although the invention described in this embodiment utilizes a Sierra Circuit, the advantages and benefits of the present invention can also be realized without use of this type of condenser. The embodiment of the hot gas defrost refrigeration system 10 shown in FIGS. 3–4 is particularly advantageous for operation in colder climates where the condenser 30 may be under larger loads. This embodiment of the invention generally includes the components shown in FIGS. 1A and 2A, but it will be understood that this embodiment or the other embodiments disclosed herein may include the components shown in FIGS. 1B and 2B, or any desired combination of components discussed above. As shown in FIGS. 3–4, the refrigeration system includes a receiver 310 generally located between the condenser 30 and evaporator 54. In detail, the passage 43 includes a tee-joint 312 connected in series with the check valve 44. The tee-joint 312 allows refrigerant to flow through passage 314 and into an inlet 315 of the receiver 310. The tee-joint 312 is also connected to bypass passage 324 which is connected to the passage 53 with the check valve 52. Thus, bypass passage 324 connects passages 43 and 53.

The receiver 310 includes an outlet 316 which is connected to passage 318. The passage 318 is connected to a tee-value 320 located in passage 45. Located between the tee-joint 320 and the solenoid valve 48 is a check valve 328 and located between the tee-joint 320 and the defrost valve 46 is a check valve 326. As with conventional receivers, the receiver 310 used in this embodiment of the present invention (1) provides heat for the inlet to the condenser 30 and (2) provides additional refrigerant into the evaporator 54. Advantageously, the receiver 310 compensates for ambient temperatures in colder climates that would otherwise be insufficient for proper operation of the condenser 30. The receiver 310 also provides the flexibility that is required for field-installation of the refrigeration system. One skilled in the art will recognize that while a receiver can be utilized with various embodiments of the present invention, the use of a receiver is not required.

FIG. 3 illustrates a preferred embodiment of the flow of refrigerant during a refrigeration cycle. In operation, the compressor 12 delivers refrigerant at high pressure and high temperature to the passage 22. The reversing valve 24, during the refrigeration cycle, directs the vapor refrigerant through the passage 26 to the condenser 30. The liquid refrigerant exits the condenser 30 through the passage 42 and enters the bypass passage 43. The closed check valve 326 causes the refrigerant to flow through the passage 43. The refrigerant traverses the open check valve 44, tee-joint 312, passage 314 and enters into the receiver 310. The refrigerant does not flow through passage 324 and into bypass passage 53 because of closed check valve 52. The liquid refrigerant exits the receiver 310 through the passage 318 and enters the passage 45 through the tee-joint 320. Check valve 328 allows the refrigerant to flow through the solenoid valve 48 and expansion valve 50 while the closed defrost valve 46 prevents the flow of refrigerant to the condenser 30. The refrigerant enters the evaporator 54 through the first liquid port 56 and exits the evaporator 54 through the first gas port 60. The refrigerant flows through the passage 62, check valve 64, passage 70 and enters the reversing valve 24. Check valve 68 prevents the refrigerant from flowing out of the first gas port 60 and into the drain pan circuit 66. The reversing valve 24 directs the refrigerant through passage 72 to the compressor 12. This completes the refrigeration circuit shown in FIG. 1.

FIG. 4 illustrates the flow of refrigerant during a defrost cycle for the preferred embodiment shown in FIG. 3. During defrost, the hot refrigerant vapor from the compressor 12 flows through the passage 22 to the reversing valve 24. The reversing valve 24 directs the hot refrigerant vapor into the passage 70. The refrigerant flows through the drain pain circuit 66 because check valve 64 is closed. The refrigerant exiting the evaporator 54 flows through the bypass passage 53 and into passage 324 because the solenoid valve 48 is closed. The refrigerant flows through the tee-joint 312 and into the receiver 310 through the passage 314. The check valve 44 prevents the refrigerant from flowing into the passage 42. The refrigerant exits the receiver 310 through passage 318 and enters the passage 45. The refrigerant traverses check valve 326, defrost valve 46, passage 42 and enters the condenser 30. The check valve 328 prevents the refrigerant from flowing to the solenoid valve 48. The refrigerant then enters the condenser 30 through the first liquid port 34 and exits the condenser 30 through the first gas port 32. The refrigerant flows through the passage 26 to the reversing valve 24 where the receiving valve 24 directs the refrigerant through passage 72 to the compressor 12. This completes the defrost cycle.

Figure 5:
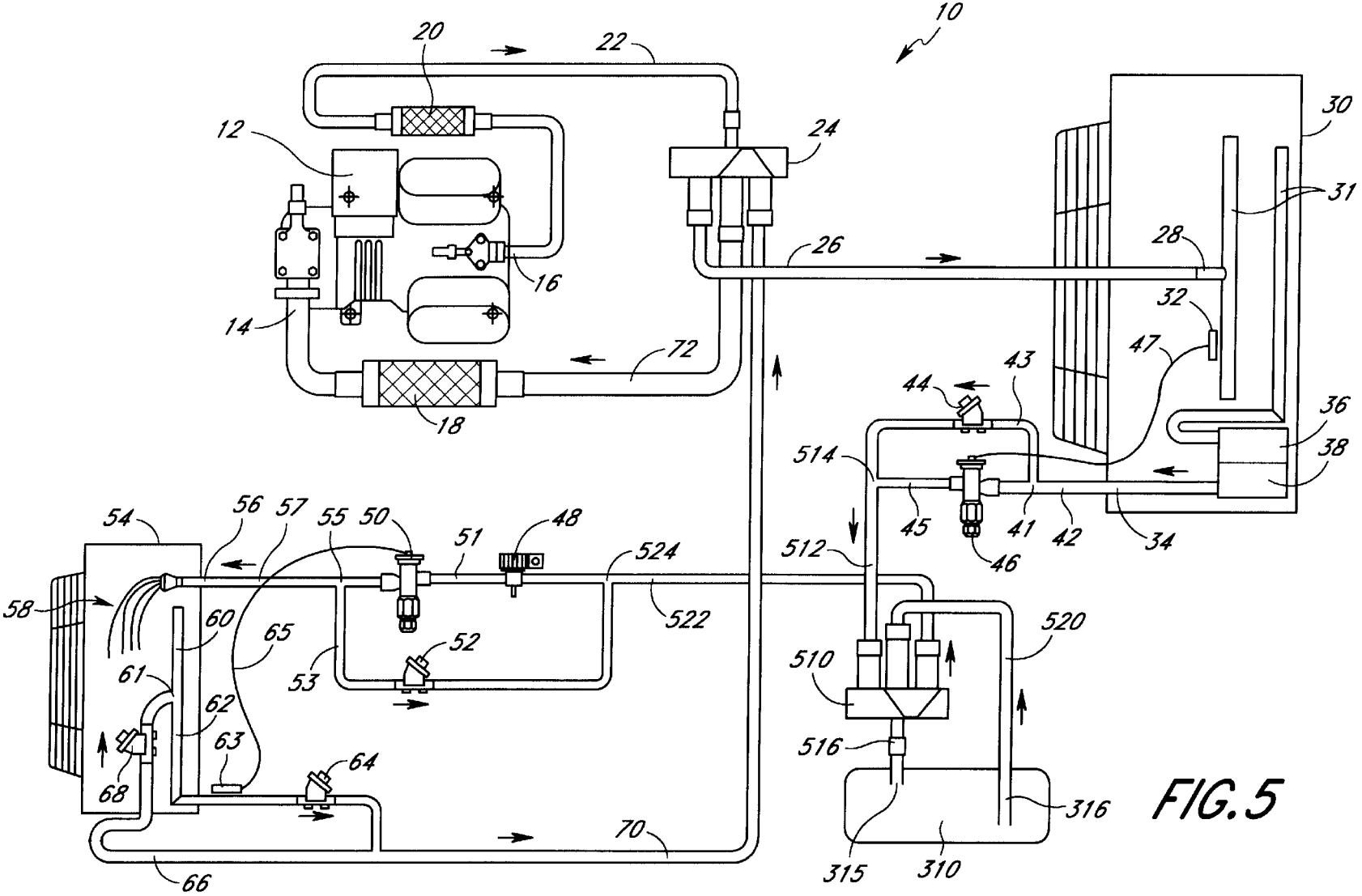
FIG. 5 is a schematic drawing of a further embodiment of the present invention, including a receiver with a reversing valve at its inlet, showing a refrigeration cycle.
Figure 6:
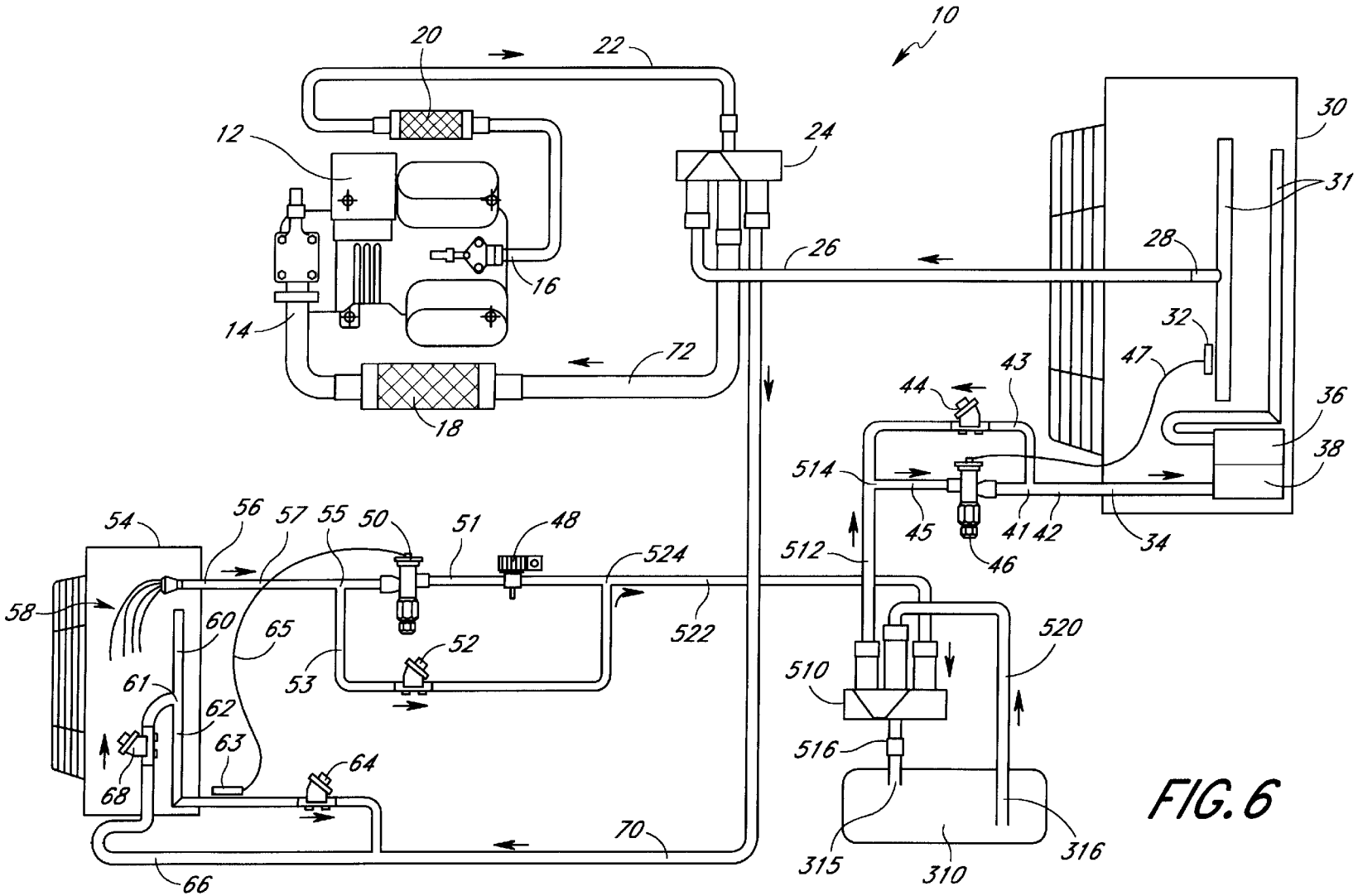
FIG. 6 is a schematic drawing of the embodiment of the system in FIG. 5, showing a defrost cycle.

The embodiment shown in FIGS. 5–6 further simplifies the utilization of the receiver 310 in the refrigeration and defrost cycles, which advantageously provides efficient operation in colder climates. This embodiment generally includes the components shown in FIGS. 3–4, but includes a second reversing valve 510 located proximate the receiver 310. The second reversing valve 510 is connected to passage 512. The passage 512 connects the reversing valve 510 to the bypass passage 43 and passage 45 by tee-joint 514. The second reversing valve 510 is also connected to the inlet 315 of the receiver 310 by passage 516. The reversing valve 510 is also connected to the outlet 316 of the receiver 310 by passage 520. Further, the reversing valve 510 is connected to passage 522, which is connected by tee-joint 524 to the bypass passage 51 and 53.

In operation of the refrigeration cycle shown in FIG. 5, the compressor 12 delivers hot vapor refrigerant to passage 22. The first reversing valve 24 directs the refrigerant through passage 26 and into the condenser 30. The refrigerant exiting the condenser 30 traverses the bypass passage 43 because the defrost valve 46 is closed. The refrigerant then flows through the passage 512 to the second reversing valve 510. The second reversing valve 510 directs the refrigerant into the receiver 310 through passage 516. The refrigerant exiting the receiver 310 flows through passage 520 where the second reversing valve 510 directs the refrigerant into the passage 522. The refrigerant traverses the solenoid valve 48 and refrigeration valve 50 and enters the evaporator 54. The refrigerant does not flow through bypass passage 53 because check valve 52 is closed. The refrigerant then traverses the evaporator 54 and exits through the passage 62. Closed check valve 68 prevents the refrigerant from flowing through the drain pan circuit 66. The refrigerant then flows through passage 70 where the first reversing valve 24 directs the refrigerant through passage 72 to the compressor 12.

In operation of the defrost cycle shown in FIG. 6, the compressor 12 delivers hot vapor refrigerant to passage 22. The first reversing valve 24 directs the hot vapor through the passage 70 where it flows through the drain pain circuit 66 because the check valve 64 prevents the refrigerant from entering passage 62. The hot vapor refrigerant defrosts the evaporator 54 and exits through the first liquid port 56. The refrigerant then flows through the bypass passage 53 because solenoid valve 48 is closed. The refrigerant then flows through passage 522 where the second reversing valve 510 directs the refrigerant into the receiver 310 through passage 516. The refrigerant exiting the receiver 310 flows into passage 520 where the second reversing valve 510 directs the refrigerant through passage 512. The refrigerant flows through the tee-joint 514 and traverses the defrost valve 46 and enters the condenser 30. The check valve 44 prevents the refrigerant from flowing through the bypass line 43. The refrigerant exiting the condenser 30 flows through passage 26 where the first reversing valve 24 directs the refrigerant through passage 72 to the compressor 12. This completes the defrost cycle. Advantageously, the embodiments shown in FIGS. 5–6 utilize substantially the same, the passages and major components of the embodiments shown in FIGS. 1–2.

Figure 7:
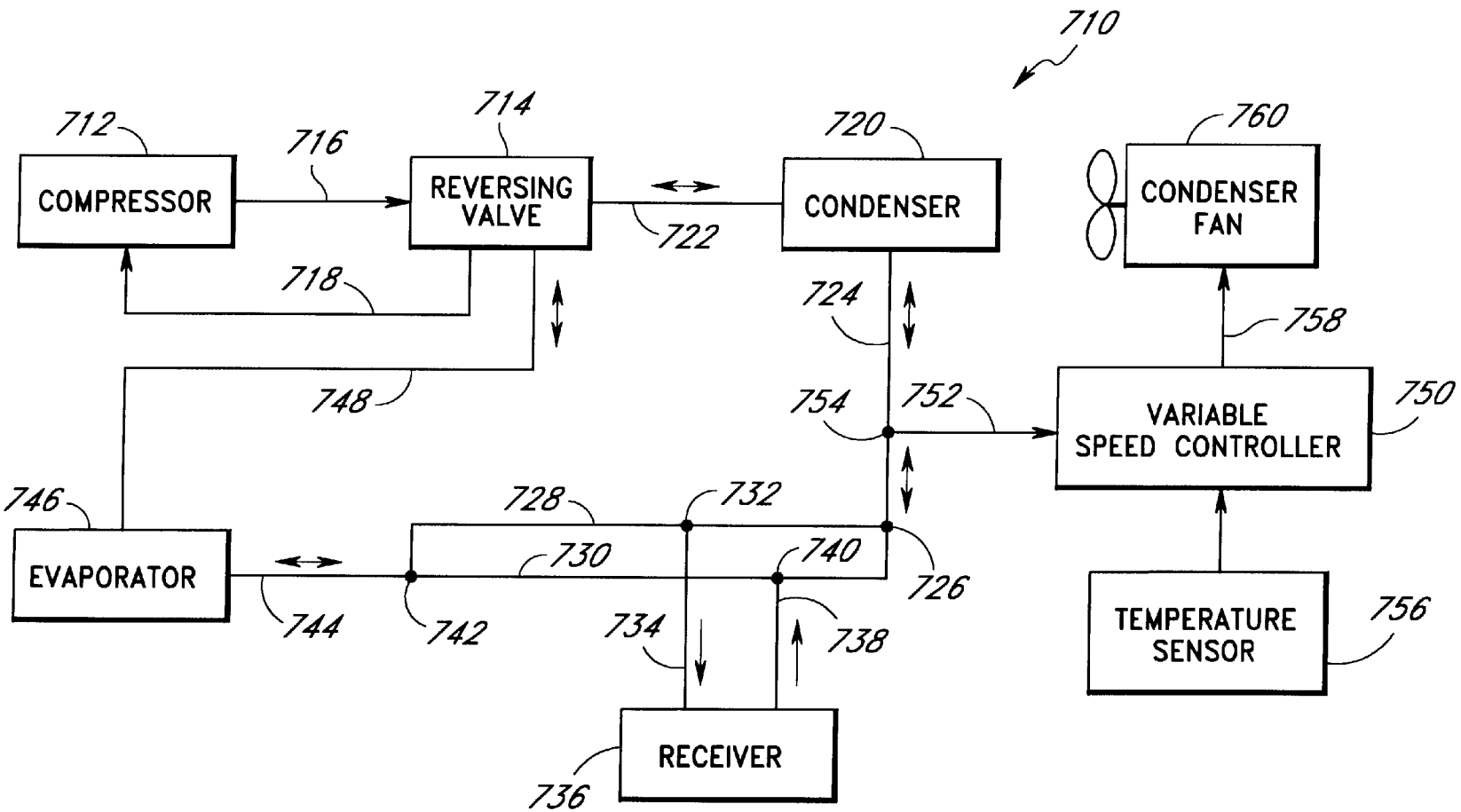
FIG. 7 is a flow chart of yet another embodiment of the present invention, including a variable speed controller for the condenser fan.

FIG. 7 illustrates a preferred embodiment of the present invention utilizing a variable speed controller for the condenser fan. As discussed above, one or more fans may be used in conjunction with the condenser to increase heat transfer between the condenser and the surrounding environment. Advantageously, the variable speed controller can be utilized with any embodiment of the present invention and, more preferably, with the embodiments shown in FIGS. 1–6. Most preferably this embodiment of the refrigeration system 710 includes a compressor 712 and a reversing valve 714. A passage 716 allows refrigerant to flow from the compressor 712 to the reversing valve 714 and passage 718 allows refrigerant to flow from the reversing valve 714 to the compressor 712. The refrigeration system 710 also includes a condenser 720 connected to the reversing valve 714 by passage 722. The passage 722 preferably allows refrigerant to flow in either direction between the condenser 720 and reversing valve 714, depending upon whether a refrigeration or defrost cycle is being used. The condenser 720 is also connected to passage 724. The passage 724 includes a tee-joint 726 which is connected to passages 728 and 730. Passage 728 includes a tee-joint 732 attached to passage 734 which is connected to the inlet of a receiver 736. The receiver 736 includes an outlet connected to passage 738. The passage 738 is connected to passage 730 by tee-joint 740. The passages 728 and 730 are connected by tee-joint 742 to passage 744, which is connected to the evaporator 746. The evaporator 746 is connected by passage 748 to reversing valve 714. The passages 724, 728, 730, 744 and 748 preferably allow refrigerant to flow in either direction, depending upon the desired refrigeration or defrost cycle.

The refrigeration system 710 shown in FIG. 7 also includes a variable speed controller 750 which is attached by a line 752 to a sensor 754. This sensor 754 measures the pressure of the refrigerant in the passage 724. Connected to the variable speed controller 750 is a temperature sensor 756 which measures the ambient temperature proximate the condenser 720. The variable speed controller 750 is connected by an electrical line 758 to the condenser fan 760. Although only one fan is shown in the accompanying figure, a plurality of fans may also be utilized. The variable speed controller 750 controls the speed of the condenser fan 760 according to the temperature measured by the sensor 756 and pressure in the passage 724. Preferably, an ALCO FV31 speed controller manufactured by the Alco Controls Division of Emerson Electric GmbH & Co. of Waiblingen, Germany is used to control the speed of the condenser fan 760. For example, the variable speed controller 750 may slow or turn the condenser fan 760 off in response to cooler ambient temperatures because the pressure difference in the refrigeration system is less than a system at warmer ambient temperatures. In particular, the range of ambient temperatures for proper operation of the refrigerant is generally from about −20° C. to +55° C. Thus, the operation of the fan is preferably controlled such that the temperature of the refrigerant generally stays within the desired temperature range. Alternatively, the controller 750 may include a switch (not shown) to select operation of the condenser fan 760 for continuous minimum speed or the fan 750 may be selectively controlled to shut off when the ambient temperature is below a predetermined point. The predetermined point, for instance, may be selected at the factory, at the time of installation or by the user. One skilled in the art will understand the predetermined point may depend upon the particular type of refrigerant used in the system or location of the refrigeration system. Advantageously, the variable speed controller 750 provides a quicker and more efficient defrost cycle so that the system may more quickly return to the refrigeration cycle.

Figure 8:
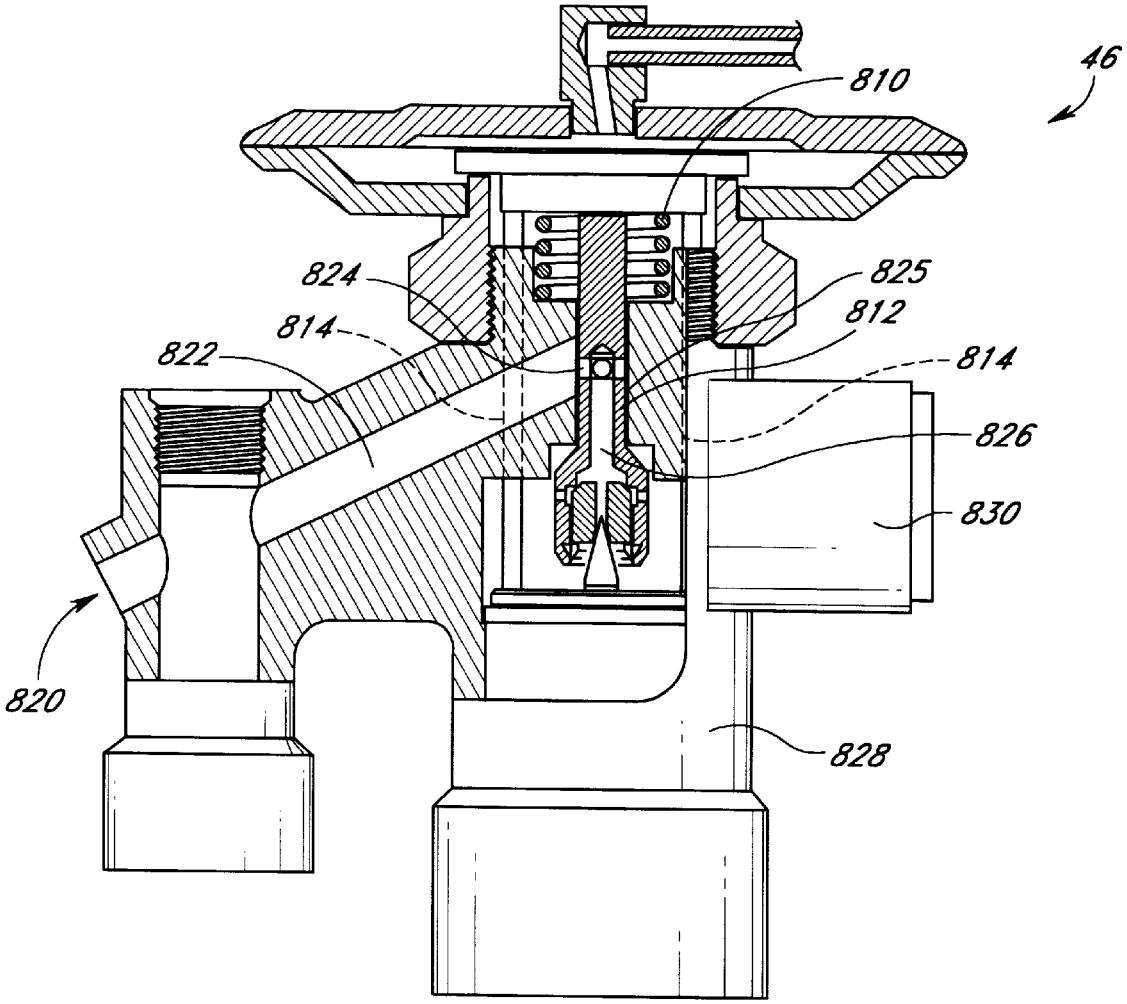
FIG. 8 is an enlarged, schematic drawing of a portion of an embodiment of the present invention showing a thermostatic expansion valve.

FIG. 8 shows a preferred embodiment of the defrost valve 46 for use with any of the embodiments of the invention. As discussed above, the defrost valve 46 is preferably a thermostatic expansion valve, and most preferably a Type EMC thermostatic expansion valve from SPORLAN Valve Company of Washington, Mo. The type EMC defrost valve advantageously allows the refrigeration system to operate in two different modes. In particular, the type EMC defrost valve operates in a "pull-down" mode when the load on the evaporator is the greatest, and in a normal or "holding" mode when the system is at its desired temperature. During the "holding" mode, the load on the evaporator is at a minimum.

In detail, the load on the refrigeration system is generally the greatest during the start of the refrigeration cycle or during a refrigeration cycle following a defrost cycle. Accordingly, the system operates in a pull-down mode because the pull-down mode allows the greatest flow of refrigerant through the system. In particular, the load during the pull-down mode can be two to three times greater than the holding mode. Accordingly, the system operates in the pull-down mode until the system reaches its desired temperature. The system operates economically during normal operation because the holding mode decreases the amount of refrigerant flowing through the defrost valve. The type EMC valve desirably includes a resealable bleed feature to allow the valve to operate with a flatter flow rate versus superheat curve. The flatter flow rate curve allows the valve to respond to changes when the refrigerant is superheated in a more stable manner.

As shown in FIG. 8, the type EMC defrost valve includes a spring 810 and a sliding piston 812. The valve includes an inlet 820 connected to a passage 822. The passage 822 allows fluid communication with a passage 824 laterally extending through a portion of the piston 812. The passage 824 is connected to a longitudinally extending passage 826. The refrigerant may also flow in an annular passage 825 surrounding the piston 812. The refrigerant flowing the valve enters a chamber 828. The fluid chamber 828 is in fluid communication with a passage 830 which allows refrigerant to leave the valve.

Figure 9A:
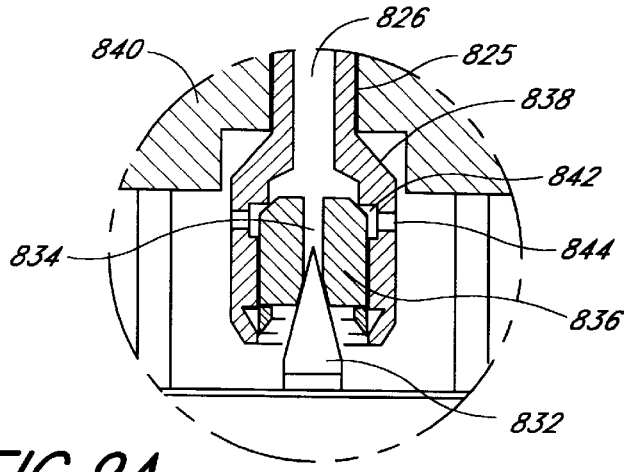
FIG. 9A is an enlarged, partially schematic diagram of the thermostatic expansion valve in FIG. 8, showing the valve in bleed port flow only.

As best seen in FIG. 9A, the type EMC valve preferably includes a resealable bleed feature. The bleed feature allows the valve to respond to changes in the refrigeration system more quickly and in a more stable manner. In detail, the refrigerant flows through the passage 822 and into the annular passageway 825 and passageway 826. The refrigerant cannot flow through the passage 826 because pin 832 prevents flow through passage 834. The pin 832 is cone-shaped to prevent flow through the passage 834. The refrigerant also cannot flow through the passage 825 because the angled portion of 838 of the piston 812 engages a portion 840 of the valve body. The refrigerant, however, can flow through the small annular opening 842 between the collar 836 and the pin 812. The refrigerant flowing through the opening 842 flows through the lateral opening 844 and in to the chamber 838.

Figure 9B:
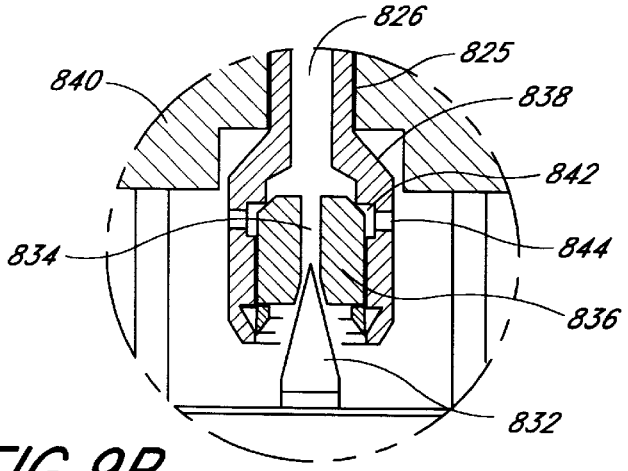
FIG. 9B is an enlarged, partially schematic diagram of the thermostatic expansion valve in FIG. 8, showing the valve in normal operation.

As best seen in FIG. 9B, the valve 46 preferably includes a holding mode. During the hold mode, the refrigerant flows through the passage 826 and the passage 834 because the pin 832 is at least partially removed from the passage 834.

Figure 9C:
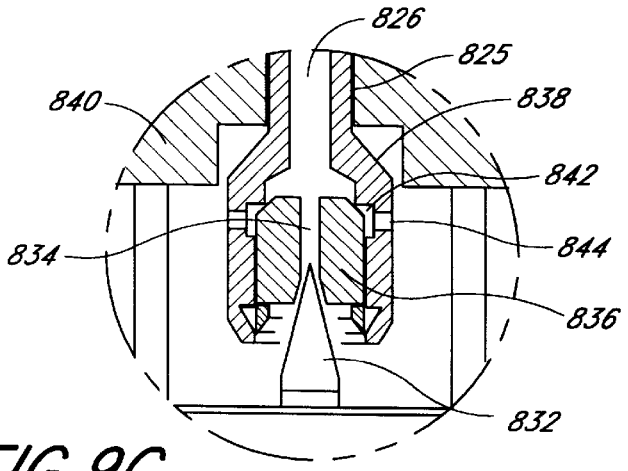
FIG. 9C is an enlarged, partially schematic diagram of the thermostatic expansion valve in FIG. 8, showing the valve in pull-down mode.

As best seen in FIG. 9C, during the pull-down mode the refrigerant can flow through passages 826 and to the chamber 828. Additionally, the refrigerant can also flow through the annular passage 825 because the piston 812 is moved downwardly to allow refrigerant flow between the valve body portion 840 and the angled portion 838 of the piston 812. Thus, the pull-down mode allows the largest amount of refrigerant to flow through the valve 46. Preferably, the pull-down mode effectively doubles the capacity of the valve in comparison to the holding mode. Thus, the type EMC valve offers varying capacity of refrigerant flow in order to maintain a substantially constant flow rate according to the pressure within the refrigeration system.

Although this invention has been described in terms of certain particular embodiments, other embodiments apparent to those of ordinary skill in the art are also within the scope of this invention. Accordingly, the scope of the invention is intended to be defined only by the claims which follow.

What is claimed is:

1. A refrigeration system having a refrigeration cycle and an evaporator defrost cycle, comprising:

a compressor having a low pressure port and a high pressure port;

a condenser having a gas port and a liquid port and a coil extending therebetween;

a temperature sensor sensing refrigerant temperature, said sensor being operatively associated with the condenser coil at a location intermediate the condenser gas port and the condenser liquid port to sense the temperature of refrigerant passing the condenser coil at said location;

an evaporator having a liquid port and a gas port;

an expansion valve disposed in a passage communicating refrigerant from the liquid port of the condenser to the liquid port of the evaporator during the refrigeration cycle;

a defrost valve disposed in a passage communicating refrigerant from the liquid port of the evaporator to the liquid port of the condenser during the defrost cycle; and a reversing valve for directing flow of the refrigerant from the high pressure port of the compressor to the gas port of the condenser during the refrigeration cycle, the reversing valve directing flow from the gas port of the evaporator to the low pressure port of the compressor during the refrigeration cycle, the reversing valve directing flow of the refrigerant from the high pressure port of the compressor to the gas port of the evaporator during the defrost cycle, the reversing valve directing flow from the condenser gas port to the low pressure port of the compressor during the defrost cycle, said defrost valve being responsive to said sensor, and said sensor being located to insure the only vapor is supplied to the compressor during the defrost cycle.

2. The refrigeration system of claim 1 wherein the condenser includes a receiver portion and a subcooler portion between the gas port and the liquid port.

3. The refrigeration system of claim 1 wherein the expansion valve and the defrost valve are in the same passage.

4. The refrigeration system of claim 1 further comprising valves disposed between the condenser and the evaporator to allow use of common fluid lines during the refrigeration and defrost cycles.

5. The refrigeration system of claim 1 further comprising a solenoid valve disposed between the condenser and the expansion valve, wherein the liquid solenoid valve is open during the refrigeration cycle and closed during the defrost cycle.

6. The refrigeration system of claim 1 further comprising:

a receiver disposed between the condenser and the evaporator, the receiver having an inlet and an outlet;

a check valve provided for refrigerant to bypass the defrost valve and enter the inlet of the receiver during the refrigeration cycle, the refrigerant flowing from the outlet of the receiver to the evaporator during the refrigeration cycle; and a valve provided for refrigerant to bypass the expansion valve and enter the inlet of the receiver during the defrost cycle, the refrigerant flowing from the outlet of the receiver to the condenser during the defrost cycle.

7. The refrigeration system of claim 1 wherein the refrigerant flows from the compressor into the evaporator during the defrost cycle via a drain pan circuit.

8. The refrigeration system of claim 1 further comprising a fan operatively coupled to the condenser, the fan having a variable speed controller.

9. The refrigeration system of claim 8 wherein the fan is responsive to pressure.

10. The refrigeration system of claim 1 wherein either the expansion valve or the defrost valve comprises a low flow port and a high flow port.

11. The refrigeration system of claim 10 wherein the high flow port is pressure activated to maintain a constant flow rate in cold climates.

12. The system of claim 1, wherein said sensor is positioned to sense the temperature of the refrigerant passing through a coil in the condenser.

13. The system of claim 12, in which the sensor is attached to said coil at a position in which the refrigerant is no longer superheated.

14. The system of claim 1, in which said sensor is located proximate said condenser gas port.

15. A refrigeration system having a refrigeration cycle and an evaporator defrost cycle, comprising:

a compressor having a low pressure port and a high pressure port;

a condenser having a gas port and a liquid port, the condenser including a coil, a receiver portion and a subcooler portion between the gas port and the liquid port;

a temperature sensor sensing refrigerant temperature, said sensor being operatively associated with the condenser coil at a location intermediate the condenser gas port and the condenser liquid port to sense the temperature of refrigerant passing the condenser coil at said location;

an evaporator having a liquid port and a gas port;

an expansion valve disposed in a passage communicating refrigerant from the liquid port of the condenser to the liquid port of the evaporator during the refrigeration cycle;

a defrost valve disposed in a passage communicating refrigerant from the liquid port of the evaporator to the liquid port of the condenser during the defrost cycle; and a reversing valve for directing flow of the refrigerant from the high pressure port of the compressor to the gas port of the condenser during the refrigeration cycle, the reversing valve directing flow from the gas port of the evaporator to the low pressure port of the compressor during the refrigeration cycle, the reversing valve directing flow of the refrigerant from the high pressure port of the compressor to the gas port of the evaporator during the defrost cycle, the reversing valve directing flow from the condenser gas port to the low pressure port of the compressor during the defrost cycle, said defrost valve being responsive to said sensor, and said sensor being located to insure the only vapor is supplied to the compressor during the defrost cycle.

16. In a refrigeration system having a compressor having a low pressure port and a high pressure port, a condenser having a gas port and a liquid port, an evaporator having a liquid port and a gas port, and a defrost valve disposed in a passage communicating refrigerant from the liquid port of the condenser to the liquid port of the evaporator during a refrigeration cycle, the method of:

communicating refrigerant from the liquid port of the evaporator to the liquid port of the condenser during a defrost cycle;

directing flow of the refrigerant from the high pressure port of the compressor to the gas port of the condenser during the refrigeration cycle;

directing flow from the gas port of the evaporator to the low pressure port of the compressor during the refrigeration cycle;

directing flow of the refrigerant from the high pressure port of the compressor to the gas port of the evaporator during the defrost cycle;

directing flow from the condenser gas port to the low pressure port of the compressor during the defrost cycle;

sensing the temperature of the refrigerant passing through the condenser during the defrost cycle at a location intermediate the liquid port and the gas port of the condenser; and controlling said defrost valve in response to the sensed refrigerant temperature to insure that only vapor is supplied to the compressor during the defrost cycle.

17. The method of claim 16 in which said controlling includes sensing the refrigerant temperature mear said condenser gas port.

* * * * *